US009051708B2

(12) United States Patent
Brown

(10) Patent No.: US 9,051,708 B2
(45) **Date of Patent: *Jun. 9, 2015**

(54) TOWER FOUNDATION

(71) Applicant: Franklin Brown, Clarkesville, GA (US)

(72) Inventor: Franklin Brown, Clarkesville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/757,400

(22) Filed: Feb. 1, 2013

(65) Prior Publication Data

US 2014/0215941 A1 Aug. 7, 2014

(51) Int. Cl.
*E02D 27/42* (2006.01)

(52) U.S. Cl.
CPC ..... *E02D 27/42* (2013.01)

(58) Field of Classification Search
CPC ..... E02D 27/42; E02D 27/01; E04G 21/14; E04H 12/2253; E04H 12/32; E04H 12/34
USPC ..... 52/294–299, 125.1–125.6, 169.1, 52/169.9, 169.13, 170, 698, 706; 248/679; 405/220, 250–252
See application file for complete search history.

(56) References Cited

U.S. PATENT DOCUMENTS 2,092,684 A * 9/1937 Uhl ..... 403/281
2,457,512 A * 12/1948 Wheeler ..... 404/15
2,984,944 A * 5/1961 Sapp ..... 52/639
3,032,089 A * 5/1962 Gutshall ..... 411/134
3,258,033 A * 6/1966 Ohnstad ..... 138/176
3,282,061 A * 11/1966 Van Geuns ..... 62/49.2
3,332,464 A * 7/1967 Castel ..... 411/155
3,587,965 A * 6/1971 Newton ..... 238/9
3,782,061 A * 1/1974 Minutoli et al. ..... 52/125.5
4,061,269 A * 12/1977 Hixson ..... 238/17
4,543,763 A * 10/1985 Ernst et al. ..... 52/698
5,118,216 A * 6/1992 Smith ..... 404/6
5,231,808 A 8/1993 Angelette
5,257,489 A 11/1993 Angelette
5,350,265 A * 9/1994 Kinner ..... 411/160
5,533,835 A 7/1996 Angelette
5,546,723 A * 8/1996 Jones ..... 52/698
5,628,599 A * 5/1997 Eakin ..... 411/163
5,730,245 A * 3/1998 Conway ..... 182/3
5,746,036 A 5/1998 Angelette
5,775,847 A * 7/1998 Carlinsky et al. ..... 405/229
5,863,164 A * 1/1999 Leistner ..... 411/181
7,753,633 B2 * 7/2010 Genick, II ..... 411/542

(Continued)

FOREIGN PATENT DOCUMENTS

EP 1033455 A1 * 9/2000

*Primary Examiner* — Jeanette E Chapman
(74) *Attorney, Agent, or Firm* — Baker Donelson; Dorian B. Kennedy

(57) ABSTRACT

A tower foundation (10) has a base slab (11), pillar slabs (12), and a crown stab (13), all of which are made of precast concrete structures. The slabs are all retained in position by steel guide rods (15) that extend upwardly from the base slab. The guide rods have externally threaded ends (16) configured to receive internally threaded mounting nuts (17). The crown slab has guide rod mounting holes (22) through which the guide rods extend. The crown slab also has compression washer assemblies (25) which include a pressure plate (26) and anchor legs (27). The pressure washer has a central mounting hole (28) coaxially aligned with the crown slab guide rod mounting holes. The pressure washer has a top surface (29) which is flush with the crown slab top surface (30). The mounting nuts bear against the pressure washer and not against the concrete.

2 Claims, 2 Drawing Sheets

(56) References Cited

U.S. PATENT DOCUMENTS 7,827,748 B2 11/2010 Brown
8,434,280 B2 * 5/2013 Liberman ..... 52/259
2002/0176749 A1 * 11/2002 Provost ..... 405/230

* cited by examiner

TOWER FOUNDATION

TECHNICAL FIELD

This invention relates to foundation slabs, and particularly to foundations made of precast concrete slabs.

BACKGROUND OF THE INVENTION

Today there exists a vast number of towers, such as cellular telephone towers, railroad communication tower utilizing microwave, radio and satellite communications, and tilt-down towers, being erected across the country. Each tower includes a foundation embedded within the ground which prevents the tower for toppling over.

In the past, these foundations have been constructed by merely digging a hole in the ground and filing the hole with concrete to which the upright towers is anchored. This has been costly in that it requires that mixed concrete in fluid form be transported to each site, requires a curing time to pass before the next step of the process can be complete, thereby slowing the construction process and increasing costs, and requires a time or inspection delay between construction events which can cause days of delays to occur.

More recently, foundations have been made of a series of precast concrete components. The precast concrete components include large slabs with holes therethrough through which guide rods extend that coupled the slabs together. A problem with these slabs has been that the guide rods tend to move slightly or vibrate with the passage of nearby trains or other vehicles or due to environmental forces upon the tower such as wind and rain. This movement can cause the guide rods to chip or wear against the hole. Additionally, the bolts threaded onto the top's of the guide rods and against the slab may also wear upon the concrete surface, thereby causing a loosening of the bolt on the guide rod and against the concrete slab.

Accordingly, it is seen that a precast tower foundation component that overcomes or alleviates the just described problems is needed. It is to the provision of such therefore that the present invention is primarily directed.

SUMMARY OF THE INVENTION

A tower foundation slab comprises a concrete body portion having a top surface, a bottom surface opposite the top surface, and a plurality of guide rod mounting holes extending between the bottom surface and the for surface. The tower foundation slab also includes a plurality of metal pressure plates partially embedded within the body portion such that the pressure plates have top surfaces which are exposed upon the body portion top surface. Each pressure plate has a guide rod mounting hole therethrough which is coaxially aligned with one body portion guide rod mounting hole.

DETAILED DESCRIPTION

Figure 1:
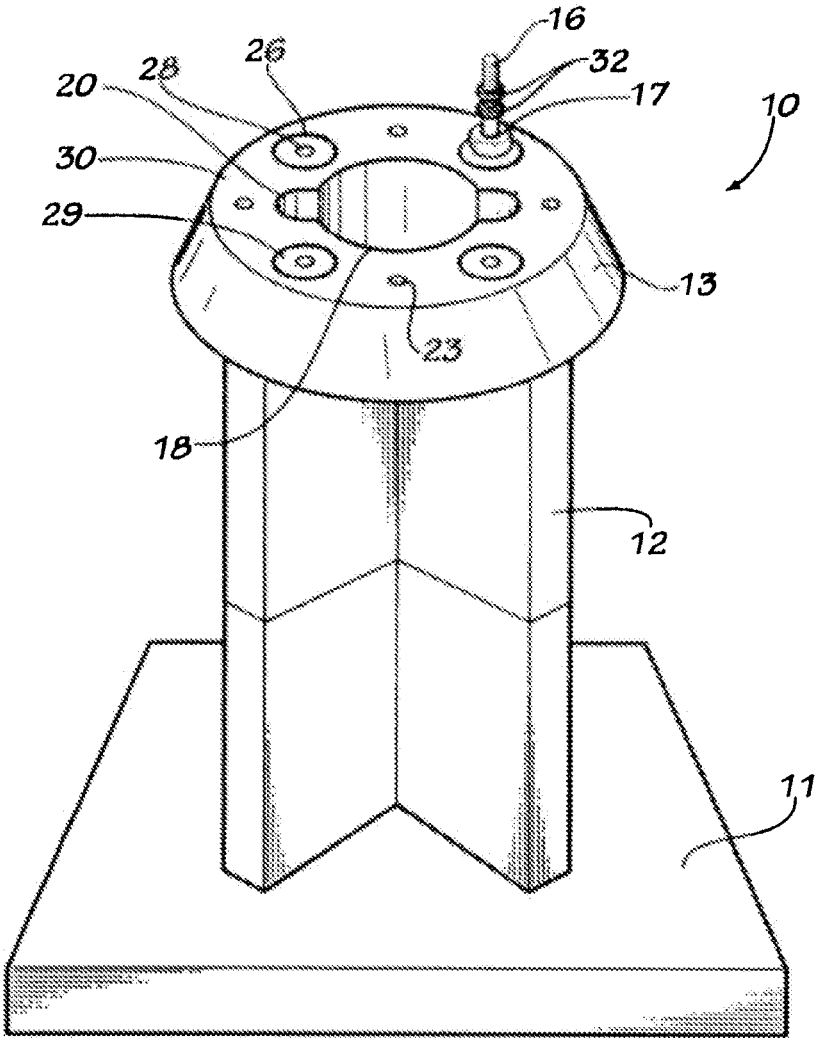
FIG. 1 is a perspective view of a tower foundation embodying principles of the invention in a preferred form.
Figure 4:
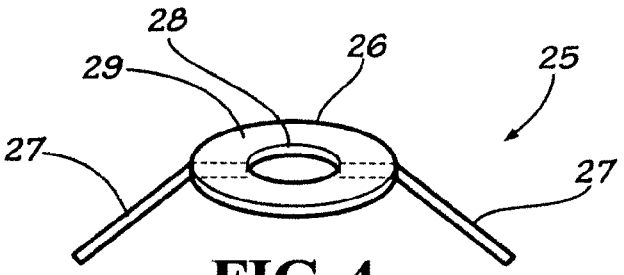
FIG. 4 is a perspective view of the compression washer assembly of the tower foundation of FIG. 1.
Figure 2:
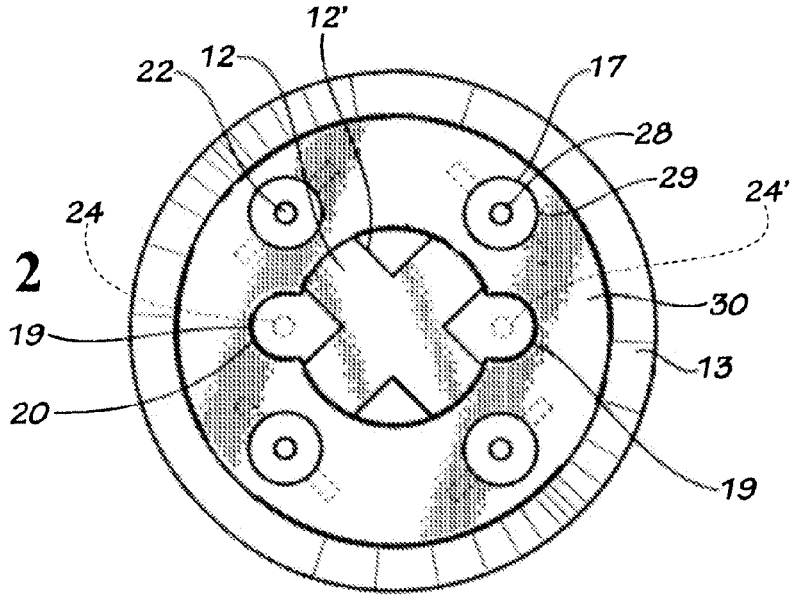
FIG. 2 is a top view of the crown slab of the foundation of FIG. 1.
Figure 3:
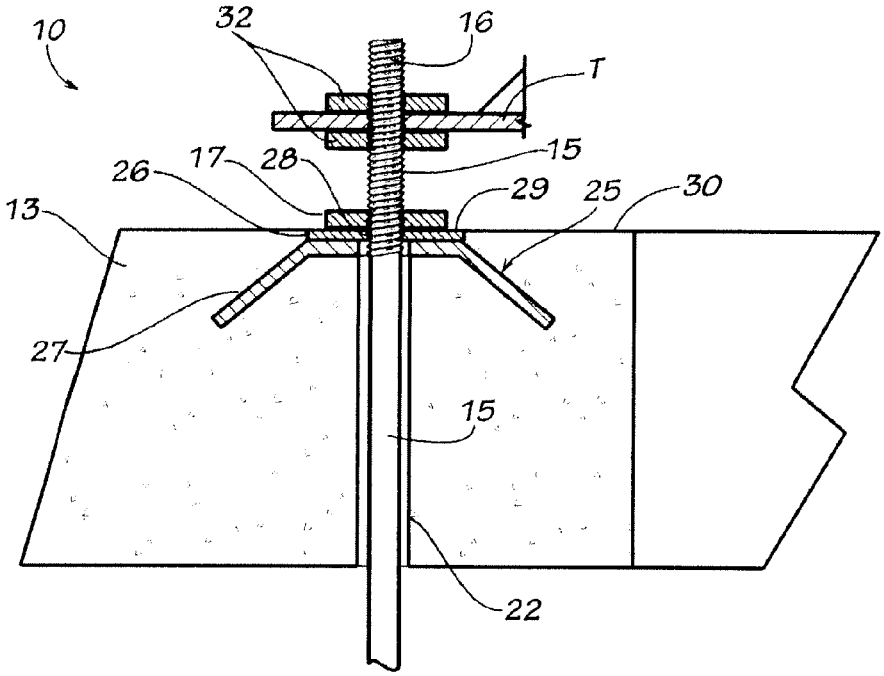
FIG. 3 is a cross-sectional view of the crown slab of a portion of the foundation of FIG. 1.

With reference next to the drawing, there is shown a tower foundation 10 of the present invention in a preferred form.

The foundation here has a base or bottom slab 11, a plurality of pillar or middle slabs 12, and a crown or top slab 13, all of which are made of precast concrete structures. The base slab 11, pillar slabs 12 and crown slab 13 are all retained in position by four steel guide rods 15 that extend upwardly from the base slab 11. The four guide rods 15 have externally threaded ends 16 configured to receive internally threaded mounting nuts 17. The guide rods 15 are arranged in a generally square pattern.

The base slab 11, pillar slabs 12 and crown slab 13 are manufactured in molds shown and described in detail in U.S. Pat. No. 5,257,489, which is specifically incorporated herein. The molds have side wall surfaces that are tapered which results in the slabs sides being tapered.

Once made, the base slab 11 is of an extremely strong and rigid construction. It also has four guide rod mounting holes that extend down to four anchor plates to which guide rods 15 are mounted. The four guide rods 15 are then mounted to the base slab 11.

The two X-shaped pillars or pillar slabs 12 that rests upon the base slab 11 are produced in a similar manner. The pillar slabs 12 have four guide rod mounting holes extending therethrough positioned to be aligned with the guide rods 15. The pillar slabs 12 are mounted on the four guide rods 15 atop the base slab 11.

Finally, the crown slab 13 is mounted atop the pillar slabs 12. The concrete crown slab 13 has a body portion with four guide rod mounting holes 22 extending therethrough through which the guide rods 15 extend. The crown slab also includes four unshown eye bolts extending from eye bolt mounting holes 23 and embedded inserts within the top surface. The crown slab 13 also has four compression washer assemblies partially embedded therein. Each compression washer assembly 25 includes a metal pressure plate, main plate, or washer 26 and a pair of oppositely disposed mounting or anchor legs 27 mounted to the pressure washer 26. The pressure washer 26 has a central mounting hole 28 coaxially aligned with the crown slab guide rod mounting holes 22 through which the guide rod extends. The pressure washer 26 has a top surface 29 which is positioned generally coplanar or flush with the top surface 30 of the crown slab and therefore exposed from the top. The anchor legs 27 are embedded within the crown slab to provide reinforcement and stability.

With this construction, the slabs 11, 12 and 13 are assembled with the guide rods extending through each slab's mounting holes and extending past the top surface 30 of the crown slab 13. This construction allows the weight of the tower to be dissipated through the pressure washer 26 and into the rest of the foundation, rather than being loaded upon the guide rods and solely to the base of the foundation. The threaded mounting nuts 17 are then threaded onto the rods to a position wherein they are in direct contact with and bear tightly against the top surface 29 of the pressure washer 26. As such, the mounting nuts 17 bear against a solid metal plate like structure. Thus, the mounting nut no longer bears against concrete which is susceptible to chipping or wearing due to vibrations or other types of movement. The elimination of the concrete wearing problem enables the nut 17 to be better secured and the tower foundation to be more rigid and therefore safer in initial construction as well as over an extended period of time.

The threaded top ends 16 of the guide rods extend past the top surface 30 of the crown slab 13. A tower T, or the like, is then coupled to the top end 16 and secured in place on each rod by a pair of tower mounting nuts 32. The relative positions of the tower mounting nuts 32 along the guide rod 15 may be adjusted to level the tower.

The pillar slabs here are rectangular with their sides being undercut or sloping outwardly from the bottom surface to the top surface, i.e., the sidewalls diverge outwardly as they extend upwardly. The foundation of FIG. 1 has a base slab 11 that measure four feet by four feet and a height of six inches. The outwardly sloping sidewalls aid in preventing the foundation from tilting over time. Once the foundation is placed in the ground and the dirt is packed tightly around the foundation the dirt is pressed tightly against the sidewalls of the pillar slabs.

Typically, the foundation of FIG. 1 is used to support cellular towers or the like, but may be used for any type of tower, signage, signal or other device. As such, the term tower foundation is not meant to be a limitation, but merely a description of one use of structure used in conjunction with the foundation.

It should be understood that any number and peripheral shape of pillar slabs may be utilized with the present invention, the number and size of slabs depends on the size and weight of the slabs and on the size, height and weight of the tower coupled thereto. Also, it should be understood that the base and crown slabs may also be configured to having tapered sidewalls.

It should be understood that while the preferred embodiment described the pressure washer top surface as being mounted "flush" with the top surface of the crown slab, slight variations should be included in the term "flush". As such, the term "flush" should also include slight or small variations between these two top surfaces and should not be construed strictly as exactly coplanar.

It thus is seen that a tower foundation is now provided that overcomes problems long associated with those of the prior art. It should be understood however that many modifications, additions and deletions may be made to the embodiments specifically described without departing from the spirit and scope of the invention as set forth in the following claims.

The invention claimed is:

1. A tower foundation slab for a tower having guide rod mounting nuts adapted to mate with guide rods coupled to said tower foundation slab comprising:

a concrete body portion having a top surface, a bottom surface opposite said top surface, and a plurality of guide rod mounting holes extending vertically between said bottom surface and said top surface, and a plurality of horizontally oriented metal pressure plates partially embedded within said body portion such that each said pressure plate has a top surface which is positioned so that said pressure plate top surface is generally flush with said body portion top surface and said top surface of said pressure plate contacting a threaded mounting nut coupled to a guide rod extending through said concrete body portion guide rod mounting hole, each said pressure plate having a vertically extending guide rod mounting hole therethrough configured to receive a guide rod therethrough, each said pressure plate guide rod mounting hole being coaxially aligned with one said body portion guide rod mounting hole, each said pressure plate having two oppositely disposed anchor legs embedded within said body portion, said anchor legs set at an angle to diverge from each other.

2. A tower foundation comprising:

a concrete base slab having a plurality of vertically oriented guide rod mounting holes, at least one concrete pillar slab having a plurality of vertically oriented guide rod mounting holes;

a concrete crown slab having a plurality of vertically oriented guide rod mounting holes, said crown slab having a metal pressure plate associated with each guide rod mounting hole, each said metal pressure plate having an exterior surface being positioned flush with a top surface of said crown slab and having a vertically oriented guide rod mounting hole axially aligned with one said crown slab guide vertically oriented rod mounting hole, each said pressure plate having two oppositely disposed anchor legs embedded within said crown slab, said anchor legs set at an angle to diverge from each other;

a plurality of vertically oriented guide rods, each said vertically oriented guide rod extending through one said base slab vertically oriented guide rod mounting hole, one said pillar slab vertically oriented guide rod mounting hole, one said crown slab vertically oriented guide rod mounting hole, and one said pressure plate vertically oriented guide rod mounting hole, and a plurality of threaded guide rod nuts, each said guide rod nut being threaded upon one said vertically oriented guide rod to a position in direct contact with and bearing against said exterior surface of one said pressure plate.

* * * * *